US011145452B2

(12) United States Patent
Kim et al.

(10) Patent No.: US 11,145,452 B2
(45) Date of Patent: Oct. 12, 2021

(54) INDUCTOR AND METHOD FOR MANUFACTURING THE SAME

(71) Applicant: SAMSUNG ELECTRO-MECHANICS CO., LTD., Suwon-si (KR)

(72) Inventors: Boum Seock Kim, Suwon-si (KR); Byeong Cheol Moon, Suwon-si (KR); Kang Wook Bong, Suwon-si (KR); Young Min Hur, Suwon-si (KR); Joung Gul Ryu, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 290 days.

(21) Appl. No.: 15/821,003

(22) Filed: Nov. 22, 2017

(65) Prior Publication Data

US 2018/0197672 A1 Jul. 12, 2018

(30) Foreign Application Priority Data

Jan. 6, 2017 (KR) ..... 10-2017-0002463

(51) Int. Cl.
*H01F 27/28* (2006.01)
*H01F 27/29* (2006.01)
(Continued)

(52) U.S. Cl.
CPC ..... *H01F 27/2804* (2013.01); *H01F 17/0013* (2013.01); *H01F 27/255* (2013.01);
(Continued)

(58) Field of Classification Search
CPC .. H01F 27/2804; H01F 17/0013; H01F 27/32; H01F 27/292; H01F 41/125;
(Continued)

(56) References Cited

U.S. PATENT DOCUMENTS 6,600,404 B1 * 7/2003 Kajino ..... H01F 5/003 257/531
9,899,136 B2 * 2/2018 Lee ..... H01F 17/0013
(Continued)

FOREIGN PATENT DOCUMENTS

CN 1532856 A 9/2004
CN 104347228 A 2/2015
(Continued)

OTHER PUBLICATIONS

Office Action issued in corresponding Chinese Application No. 201810001414.4, dated Apr. 23, 2019.
(Continued)

*Primary Examiner* — Tuyen T Nguyen
(74) *Attorney, Agent, or Firm* — Morgan, Lewis & Bockius LLP

(57) ABSTRACT

An inductor includes a body including a support member, a coil, and an encapsulant, and external electrodes on external surfaces of the body. The coil in the body may be formed so that a plurality of coil patterns are continuously formed, wherein the coil pattern includes first and second coil layers, and the encapsulant extends downward between adjacent coil patterns to be between first coil layers of adjacent coil patterns.

12 Claims, 7 Drawing Sheets

(51) Int. Cl.

| | |
|---|---|
| ***H01F 41/12*** | (2006.01) |
| ***H01F 27/32*** | (2006.01) |
| ***H01F 41/04*** | (2006.01) |
| ***H01F 27/255*** | (2006.01) |
| ***H01F 17/00*** | (2006.01) |

(52) U.S. Cl.
CPC ..... *H01F 27/28* (2013.01); *H01F 27/292* (2013.01); *H01F 27/32* (2013.01); *H01F 27/324* (2013.01); *H01F 41/041* (2013.01); *H01F 41/125* (2013.01)

(58) Field of Classification Search
CPC .... H01F 27/324; H01F 41/041; H01F 27/255; H01F 27/306; H01F 27/323; H01F 41/046; H01F 41/10; H01F 41/122; H01F 2027/2809; H01F 2017/048; H01F 27/022; H01F 41/12
See application file for complete search history.

(56) References Cited

U.S. PATENT DOCUMENTS

| | | | | |
|---|---|---|---|---|
| 10,304,620 | B2 * | 5/2019 | Lee | H01F 27/324 |
| 2003/0002210 | A1 | 1/2003 | Inaguma | |
| 2004/0123449 | A1 | 7/2004 | Inaguma | |
| 2004/0263309 | A1 | 12/2004 | Ito et al. | |
| 2013/0222101 | A1 * | 8/2013 | Ito | H01F 5/003 336/83 |
| 2015/0028983 | A1 | 1/2015 | Ryu et al. | |
| 2015/0035640 | A1 * | 2/2015 | Wang | H01F 27/2804 336/200 |
| 2015/0048918 | A1 | 2/2015 | Park et al. | |
| 2015/0109088 | A1 | 4/2015 | Kim et al. | |
| 2015/0270053 | A1 | 9/2015 | Cha et al. | |
| 2015/0340149 | A1 * | 11/2015 | Lee | H05K 1/181 174/260 |
| 2016/0163444 | A1 | 6/2016 | Choi et al. | |
| 2016/0293320 | A1 | 10/2016 | Kim et al. | |
| 2016/0336105 | A1 | 11/2016 | Choi et al. | |
| 2017/0330674 | A1 * | 11/2017 | Lee | H01F 5/00 |
| 2018/0019051 | A1 * | 1/2018 | Bong | H01F 27/255 |
| 2019/0198216 | A1 * | 6/2019 | Lee | H01F 27/24 |

FOREIGN PATENT DOCUMENTS

| | | | |
|---|---|---|---|
| CN | 104376954 | A | 2/2015 |
| CN | 104766715 | A | 7/2015 |
| CN | 104934187 | A | 9/2015 |
| CN | 105185507 | A | 12/2015 |
| CN | 105448503 | A | 3/2016 |
| JP | 02-156624 | A | 6/1990 |
| JP | 10-241983 | A | 9/1998 |
| JP | 2002-343639 | A | 11/2002 |
| JP | 2004-260017 | A | 9/2004 |
| JP | 2008-166455 | A | 7/2008 |
| JP | 2015-082660 | A | 4/2015 |
| JP | 2015-228479 | A | 12/2015 |
| JP | 2016-197712 | A | 11/2016 |
| KR | 10-1999-0066108 | A | 8/1999 |
| KR | 10-2015-0108518 | | 9/2015 |
| KR | 10-2016-0132593 | | 11/2016 |

OTHER PUBLICATIONS

Japanese Office Action issued in corresponding Japanese Patent Application No. 2017-225084, dated Aug. 14, 2018, with English Translation.

* cited by examiner

INDUCTOR AND METHOD FOR MANUFACTURING THE SAME

CROSS-REFERENCE TO RELATED APPLICATION(S)

This application claims benefit of priority to Korean Patent Application No. 10-2017-0002463 filed on Jan. 6, 2017 in the Korean Intellectual Property Office, the disclosure of which is incorporated herein by reference in its entirety.

BACKGROUND

1. Field

The present disclosure relates to an inductor and a method for manufacturing the same, and more particularly, to a thin-film type power inductor having a small size and high inductance, and a method for manufacturing the same.

2. Description of Related Art

The miniaturization and thinning of electronic devices have accelerated and increased the market demand for small, thin electronic components, such as inductors.

Korean Patent Laid-Open Publication No. 10-1999-0066108 provides a power inductor including a substrate having a via hole to be suitable for a current technical trend and coils disposed on both surfaces of the substrate and electrically connected to each other through the via hole of the substrate, in order to provide an inductor having a uniform coil with a large aspect ratio. However, the ability to form uniform coils with a large aspect ratio is still limited due to limitations in the manufacturing process.

SUMMARY

An aspect of the present disclosure may provide an inductor in which alignment of coils having a high aspect ratio is improved, and a method for manufacturing the same.

According to an aspect of the present disclosure, an inductor may include: a body including a support member, a coil supported by the support member, and an encapsulant encapsulating the support member and the coil. External electrodes may be on respective external surfaces of the body. The coil may include a plurality of coil patterns, wherein each of the plurality of coil patterns includes a first coil layer and a second coil layer on the first coil layer. The encapsulant may contain magnetic powder and fill spaces between adjacent coil patterns. The encapsulant may extend downward between adjacent coil patterns to be between first coil layers of adjacent coil patterns.

According to another aspect of the present disclosure, a method for manufacturing an inductor may include the following steps. A support member including a via hole may be prepared. A conductive metal layer may be formed on at least one surface of the support member and in the via hole. The conductive metal layer may be delaminated on one surface of the support member. A first metal layer may be formed on one surface of the support member. An insulator may be disposed on the first metal layer. The insulator may be patterned to be a plurality of partition walls. A second plating layer may be formed in a space between the partition walls. The insulator and at least a portion of the first metal layer disposed below the insulator may be simultaneously removed. An insulating layer may be coated to entirely enclose the second metal layer and an exposed surface of the first metal layer disposed below the second metal layer. An encapsulant may be filled to encapsulate the first and second metal layers. External electrodes may be formed on respective external surfaces of the encapsulant.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

An inductor and a method for manufacturing the same according to an exemplary embodiment in the present disclosure will be described, but are not necessarily limited thereto.

Inductor

Figure 1:
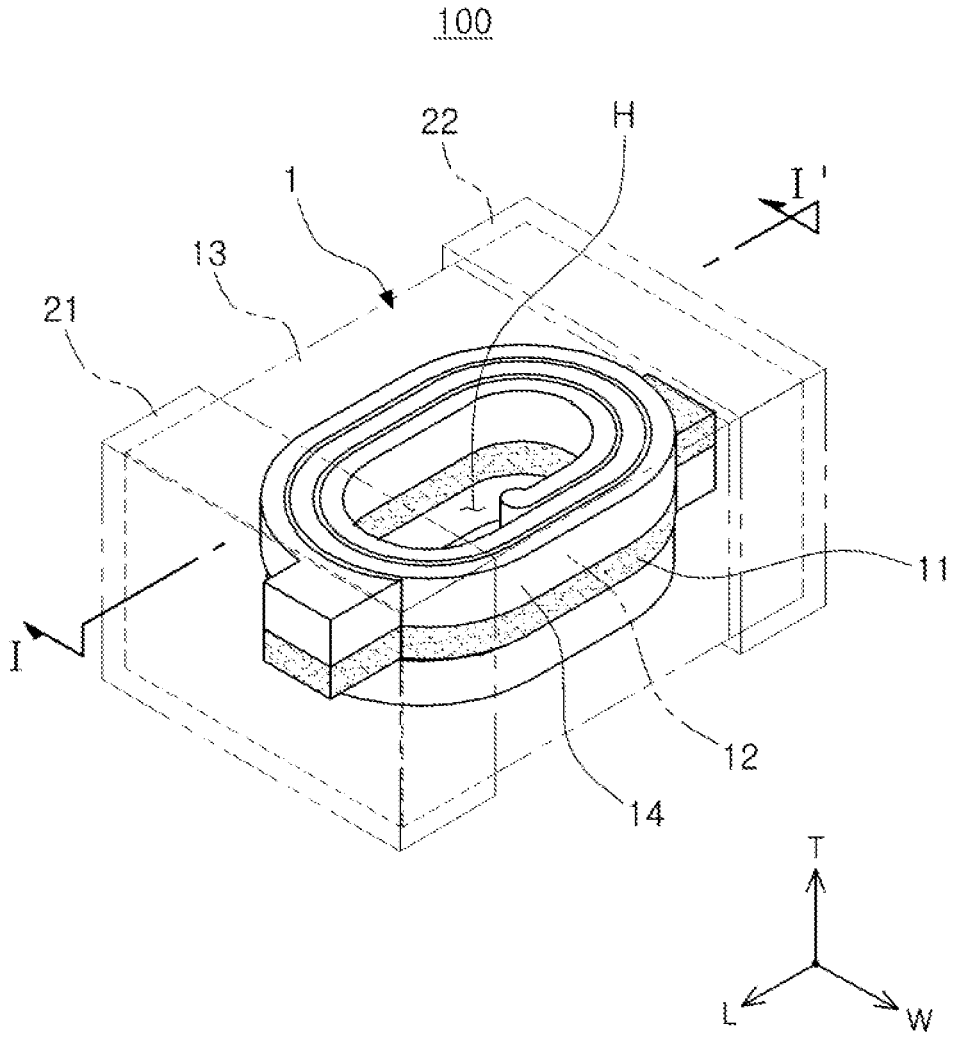
FIG. 1 is a schematic perspective view of an inductor according to an exemplary embodiment in the present disclosure.
Figure 2:
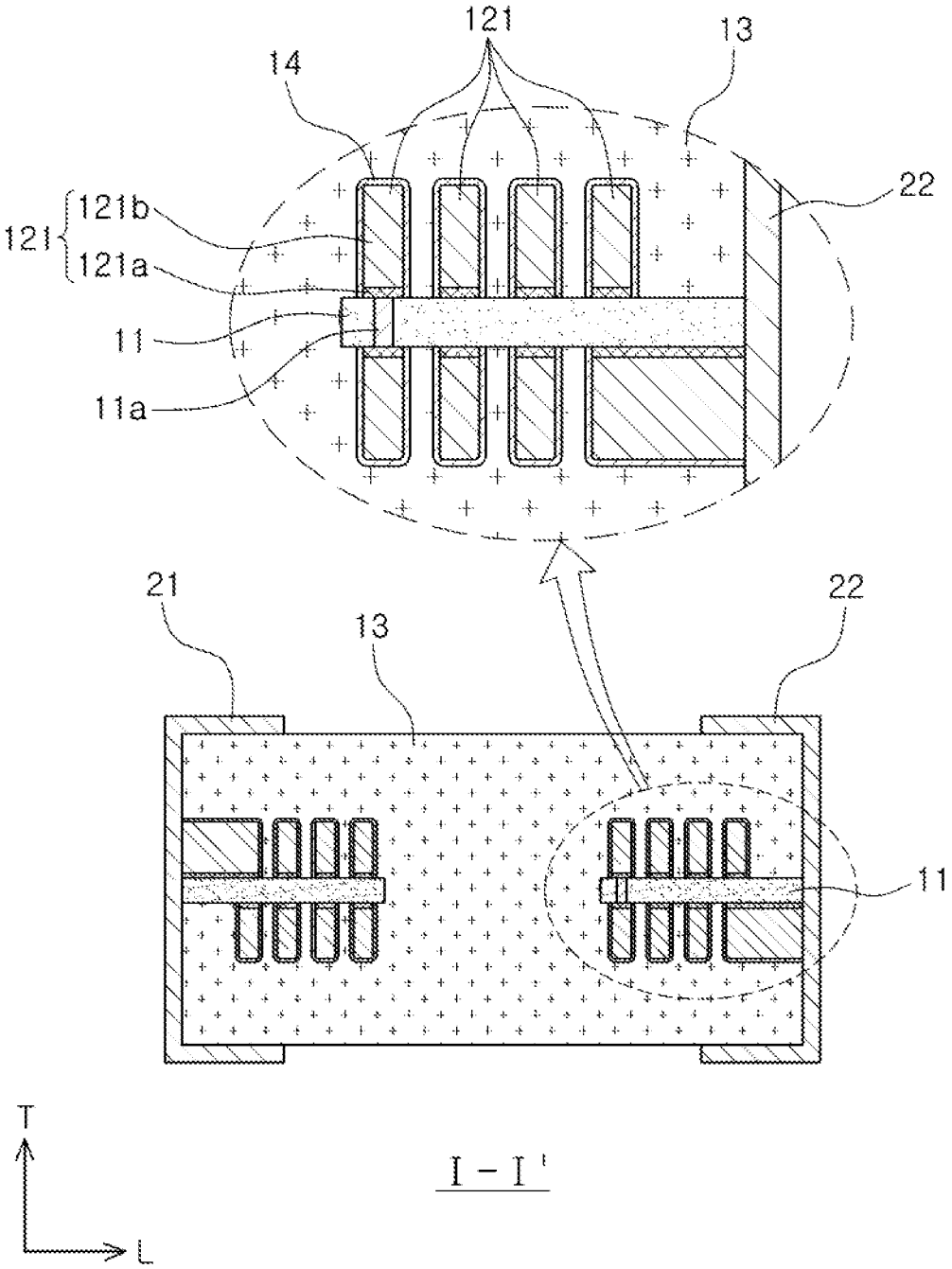
FIG. 2 is a cross-sectional view taken along line I-I' of FIG. 1.

FIG. 1 is a schematic perspective view of an inductor according to an exemplary embodiment in the present disclosure. FIG. 2 is a cross-sectional view taken along line I-I' of FIG. 1.

Referring to FIGS. 1 and 2, an inductor 100 according to the exemplary embodiment in the present disclosure may include a body 1 and first and second external electrodes 21 and 22 disposed on respective external surfaces of the body.

The first and second external electrodes 21 and 22 may contain a metal having excellent electrical conductivity, including for example, nickel (Ni), copper (Cu), tin (Sn), silver (Ag), or the like, or an alloy thereof, etc. The method for forming the first and second external electrodes and specific shapes of the first and second external electrodes is not limited. For example, the first and second external electrodes maybe formed in an "C" shape using a dipping method.

The body 1 may provide an exterior of the inductor and have an upper surface and a lower surface opposing each other in a thickness (T) direction, a first surface and a second surface opposing each other in a length (L) direction, and a third surface and a fourth surface opposing each other in a width (W) direction. The body 1 may have a substantially hexahedral shape, but is not limited thereto. The dimension the body extended in the thickness direction is referred to herein as the "thickness" or "height."

The body 1 may include a support member 11, a coil 12 supported by the support member, and an encapsulant 13 encapsulating the support member and the coil.

The encapsulant 13 may contain magnetic particles. The magnetic particles may be formed of, for example, one or more selected from the group consisting of iron (Fe), silicon (Si), chromium (Cr), aluminum (Al), and nickel (Ni), or ferrite. The encapsulant may be formed of a magnetic particle-resin composite in which magnetic particles are filled in a resin.

The support member 11 is provided to more thinly and easily form the coil. The support member may be an insulating substrate formed of an insulating resin. Here, as the insulating resin, a thermosetting resin such as an epoxy resin, a thermoplastic resin such as polyimide, resins in which a reinforcement material, such as a glass fiber or an inorganic filler, is impregnated in the thermosetting resin and the thermoplastic resin, for example, a prepreg, an ajinomoto build-up film (ABF), FR-4, a bismaleimide triazine (BT) resin, a photo imageable dielectric (PID) resin, or the like, may be used. Including glass fiber in the support member may improve rigidity.

A through hole H may be formed in a central portion of the support member. The through hole may be filled with a material having magnetic properties to thereby form a core part.

The support member may include a penetration via 11*a* penetrating from an upper surface of the support member to a lower surface of the support member, and the penetration via 11*a* may be formed by processing a via hole in the support member and filling a conductive material in the via hole.

The coil 12 may be supported on the upper and lower surfaces of the support member and include a plurality of coil patterns 121. Each coil pattern 121 may include a first coil layer 121*a* and a second coil layer 121*b* disposed on the first coil layer.

The first coil layer 121*a* may serve as a seed layer based on the second coil layer 121*b*. Generally, the seed layer may have a structure in which an entire external surface thereof is covered by a plating layer disposed thereon. However, for the first coil layer of the coil pattern of the inductor according to the present disclosure, only an upper surface thereof may be entirely covered by the second coil layer disposed thereon, and at least a portion of a side surface thereof is not covered by the second coil layer disposed thereon but may instead be covered by the encapsulant 13 having magnetic properties. Of course, an insulating layer may be additionally coated on the coil pattern for insulation between the magnetic particles in the encapsulant and the coil pattern. Since the upper surface of the first coil layer comes in contact with a lower surface of the second coil layer and the side surface of the first coil layer is not covered by the second coil layer, a width of the upper surface of the first coil layer may be substantially equal to that of the lower surface of the second coil layer.

Referring to FIG. 2, an average distance L1 between adjacent first coil layers may be substantially equal to an average distance L2 between adjacent second coil layers, meaning that an aspect ratio of the coil pattern composed of the first and second coil layers maybe sufficiently increased. Here, "substantially equal" means that the difference is within the amount of variation that would be expected when one layer acts as a mask for trimming the other layer, for example by a laser trimming method. Generally, an average distance between seed layers disposed to contact a support member is larger than an average distance between plating layers disposed on the seed layers. In this case, it is significantly difficult to allow distances between the plating layers to be uniformly maintained at a predetermined level or more. Therefore, there is a limitation in allowing the plating layer to grow in a thickness direction, such that an aspect ratio is not sufficiently increased.

Unlike the related art, since the average distance between the first coil layers and the average distance between the second coil layers are substantially equal to each other, the aspect ratio of the coil pattern may be uniformly and stably increased. In detail, the aspect ratio of the coil may be 2 or more to 20 or less. When the aspect ratio is less than 2, an effect of improving electric properties, or the like, of the coil may not be sufficient. When the aspect ratio is more than 20, the process of forming the coil pattern may encounter difficulties such as, for example, collapse of the coil pattern, occurrence of warpage of the support member, or the like.

The first and second coil layers may be formed of the same material as each other, but more preferably, the first and second coil layers may be formed of different materials from each other. An example of the material capable of being applied to the first and second coil layers may include one or more of copper (Cu), titanium (Ti), nickel (Ni), tin (Sn), molybdenum (Mo), and aluminum (Al). In particular, it is preferable that the first coil layer contains titanium (Ti) or nickel (Ni), and the second coil layer disposed on the first coil layer contains copper (Cu). This is an applicable example in all consideration of electric conductivity, economical efficiency, and ease of process. Therefore, the first coil layer and the penetration via coming in contact with at least a portion of the first coil layer may be formed of different materials from each other. Similarly, the first coil layer may contain titanium (Ti) or nickel (Ni), and the penetration via may contain copper (Cu). In this case, there may be a boundary surface between the first coil layer and the penetration via, such that the first coil layer and the penetration via may be discontinuously disposed. For reference, in a structure of a general inductor, a penetration via and a seed layer connected to the penetration via are simultaneously and continuously formed, such that it is impossible to distinguish the penetration via and the seed layer from each other. However, in the inductor according to the present disclosure, since the penetration via and the first coil layer on the penetration via are formed by different processes from each other, the penetration via and the first coil layer may be distinguished from each other and discontinuously formed.

A surface of the coil pattern composed of the first and second coil layers maybe coated by an insulating layer 14. The insulating layer 14 is formed depending on the shape of the external surface of the coil pattern on which it is formed, meaning that the insulating layer can be uniform and thin. Any material may be used in the insulating layer 14 as long as it may form a uniform insulating film formed of a polymer. Examples of the material of the insulating layer 14 may include poly(p-xylylene), an epoxy resin, a polyimide resin, a phenoxy resin, a polysulfone resin, and a polycarbonate resin, or a resin of a perylene based compound. The perylene based compound is preferable in that a uniform and stable insulating layer may be implemented by a chemical vapor deposition method.

An examplary method for manufacturing the inductor described above is described below, such that a structure of the inductor and technical effects derived from the structure will be described in more detail.

Method for Manufacturing Inductor

Before describing a method for manufacturing an inductor according to an exemplary embodiment of the present disclosure, a general method for manufacturing a thin film inductor according to the related art will be described with reference to FIGS. 3A through 3D.

Figure 3A:
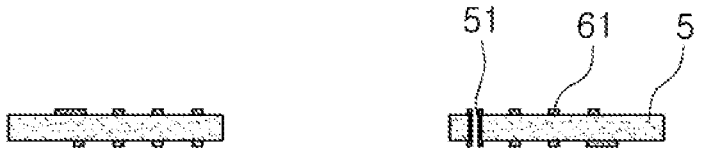
FIGS. 3A through 3D are process views schematically illustrating a general method for manufacturing a thin film inductor according to the related art as a comparative example.

FIG. 3A illustrates forming a copper seed layer 61 on at least a portion of an upper surface of a support member 5 in which a via hole 51 is formed. The copper seed layer 61 is formed to be continuously extended to the inside of the via hole of the support member.

Figure 3B:
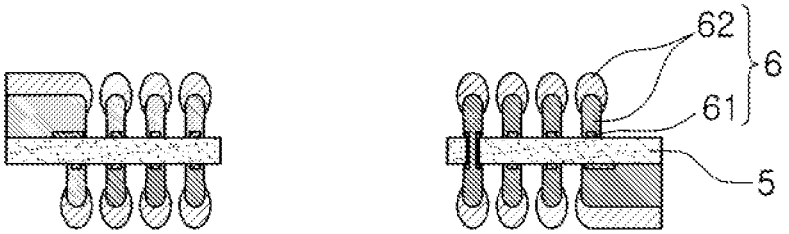

FIG. 3B illustrates additionally forming copper plating layer 62 on the copper seed layer 61. The copper plating layer is formed by anisotropic plating in order to increase the aspect ratio. This may lead to a problem where the cross-sectional shape of the copper plating layer is not uniform, and the copper plating layer is formed such that it has a substantially mushroom shape.

Figure 3C:
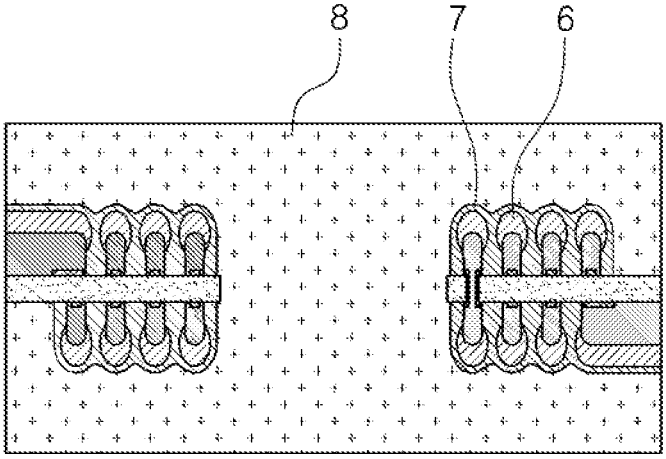

FIG. 3C illustrates forming an insulating layer 7 to insulate a surface of a coil 6 composed of the copper seed layer and the copper plating layer, and encapsulating the coil and the support member with an encapsulant 8 having magnetic properties.

Figure 3D:
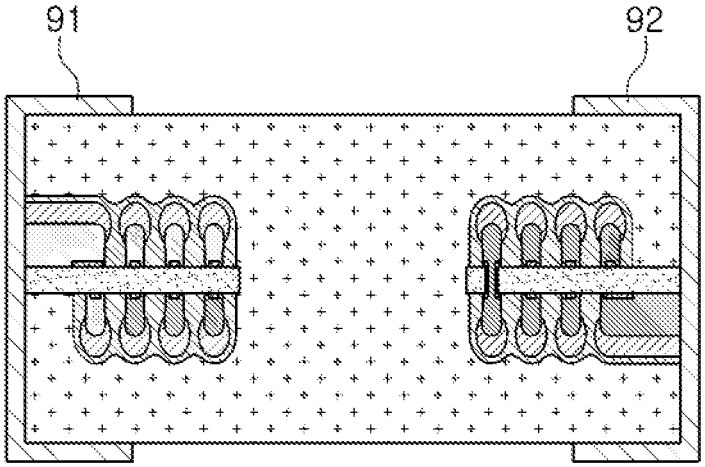

FIG. 3D illustrates forming external electrodes 91 and 92 after performing a finishing process on the support member and the coil encapsulated by the encapsulant.

When forming the thin film inductor using a general method as described above, since the coil may not grow uniformly, there is a limitation in increasing the aspect ratio of the coil.

The method for manufacturing an inductor according to an exemplary embodiment in the present disclosure, described below, is provided to solve the above-mentioned problem and my significantly increase the aspect ratio of the coil to about 2 or more to 20 or less. Further, the method may prevent a problem occurring due to misalignment of the position of the coil seed layer disposed below the coil plating layer and the formation position of the coil plating layer while the coil plating layer, performing a critical role, particularly in increasing the aspect ratio of the coil, is formed. A description of the alignment will be described in detail with reference to FIG. 4E.

FIGS. 4A through 4I are process views illustrating an example of a method for manufacturing an inductor according to an exemplary embodiment in the present disclosure. Here, for convenience of explanation, the same reference numerals will be used to describe components corresponding to the components in FIG. 3.

Figure 4A:
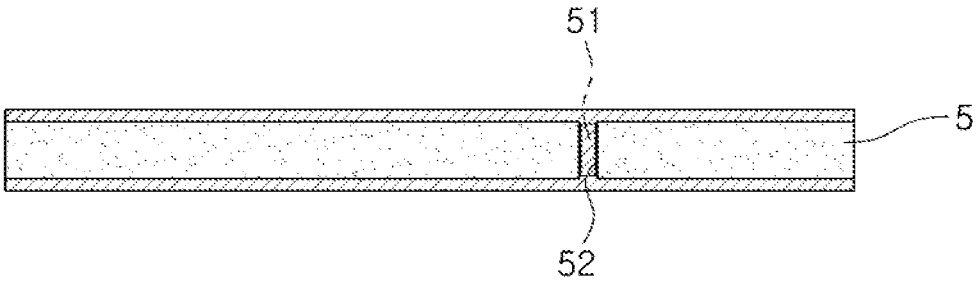
FIGS. 4A through 4I are process views schematically illustrating an example of a method for manufacturing an inductor according to an exemplary embodiment in the present disclosure.

Referring to FIG. 4A, after a support member 5 in which a via hole 51 is formed is prepared, a copper seed layer to be filled in the via hole to form a penetration via 52 may be formed. The copper seed layer may mean a conductive metal layer formed on an upper surface of the support member and formed in the via hole. In this case, a material of the conductive metal layer is not limited to copper.

Figure 4B:
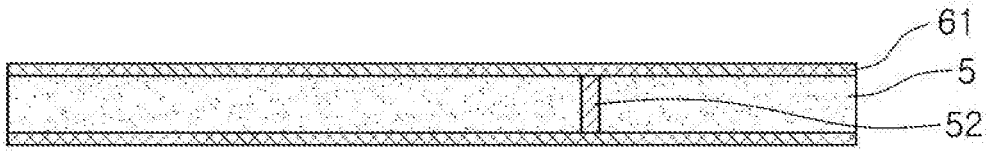

Referring to FIG. 4B, except for the penetration via of the copper seed layer formed in FIG. 4A, the conductive metal layer disposed on the upper surface of the support member may be delaminated. Subsequently, a first metal layer 61 may be formed on a position at which the conductive metal layer is delaminated. The method for forming the first metal layer is not limited as long as a uniform and thin metal layer may be formed. For example, a sputtering method, a chemical cooper plating method, a chemical vapor deposition (CVD) method, or the like, may be used. The thickness of the first plating layer may be suitably determined through design by those skilled in the art. For example, the thickness of the first plating layer may be 50 nm or more to 1 μm or less, but is not particularly limited. The material of the first metal layer is not particularly limited as long as it has electric conductivity. However, considering partial removal of the first metal layer to be described below, it is preferable that the first metal layer contains titanium (Ti) or nickel (Ni) as a main ingredient in order to significantly decrease the first metal layer that will remain.

Figure 4C:
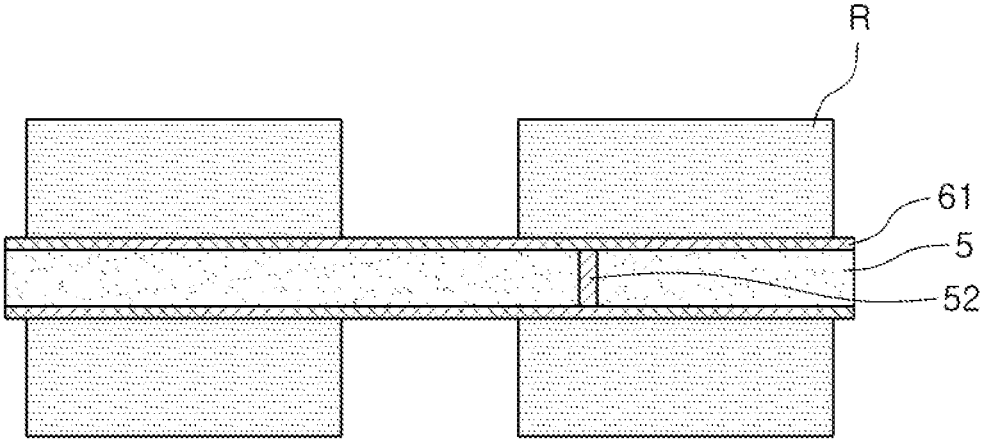

FIG. 4C illustrates disposing an insulator R on the first metal layer. The insulator may contain an epoxy based compound. For example, the insulator may contain a photosensitive material, which is a permanent type photosensitive insulating material, containing a bisphenol based epoxy resin as a main ingredient. Further, the insulator may also have a structure in which a plurality of insulating sheets are laminated.

Figure 4D:
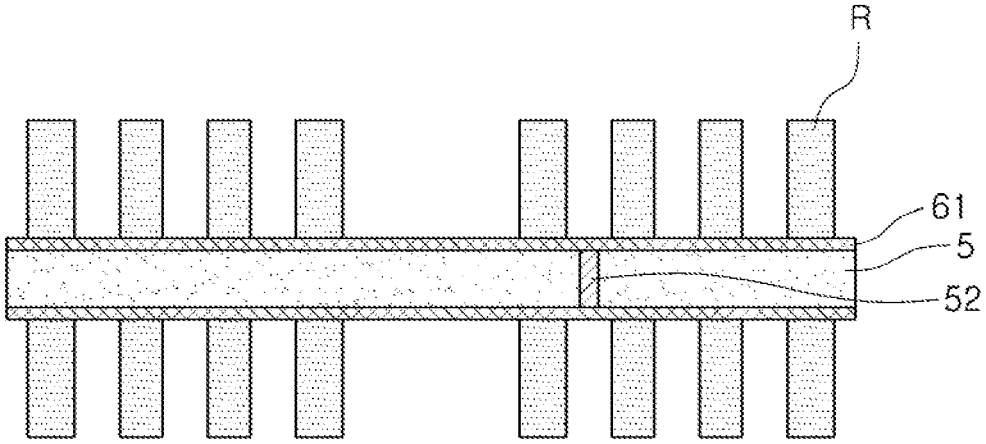

FIG. 4D illustrates patterning the insulator to have a plurality of partition wall patterns. The method for patterning the insulator may be a printing method, a photolithography method, or the like, but the method is not limited thereto. For example, the desired partition wall pattern may be formed by performing selective exposure and development on the insulator. The partition wall pattern may be formed to have a significantly high aspect ratio of about 100 or so, meaning that the thickness of the partition wall pattern is significantly large as compared to the width of the partition wall pattern, such that a coil to be described below may have a fine line width.

Figure 4E:
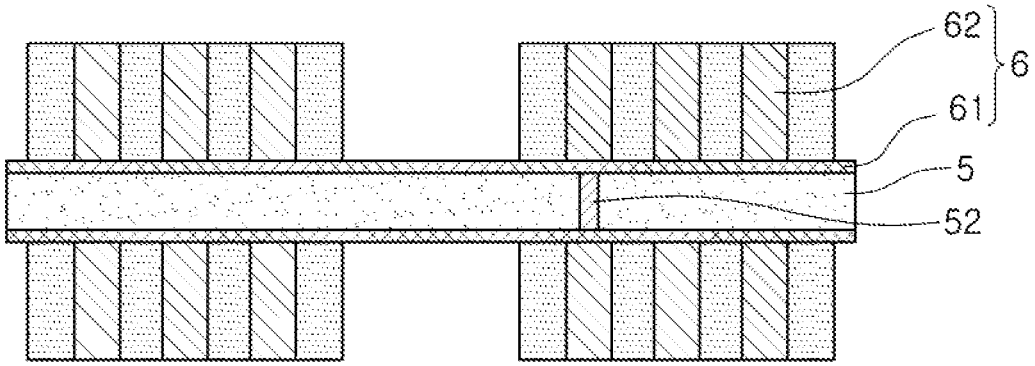

FIG. 4E illustrates forming a second plating layer 62 between the partition wall patterns formed in FIG. 4D. In this case, since the first plating layer serves as a seed layer with respect to the second plating layer, alignment between the first and second plating layers is important. With the method for manufacturing an inductor according to the present disclosure, since the first plating layer is continuously disposed on the upper surface of the support member, a formation position of an opening of the partition wall pattern or the second plating layer is not particularly limited. As a result, it may be easy to allow coil patterns 6 composed of the first and second plating layers to have a fine line width therebetween. In FIG. 4E, when an upper surface of the second plating layer is positioned to be higher than an upper surface of the partition wall pattern contacting a side surface of the second plating layer, in order to prevent short-circuit between adjacent second plating layers, there is a need to polish the second plating layers. The polishing method may be a mechanical polishing method or a chemical polishing method. This may be suitably changed by those skilled in the art depending on design requirement. Meanwhile, when the upper surface of the second plating layer is positioned to be lower than the upper surface of the partition wall pattern contacting a side surface of the second plating layer to thereby be underplated, the above-mentioned polishing may be omitted.

Figure 4F:
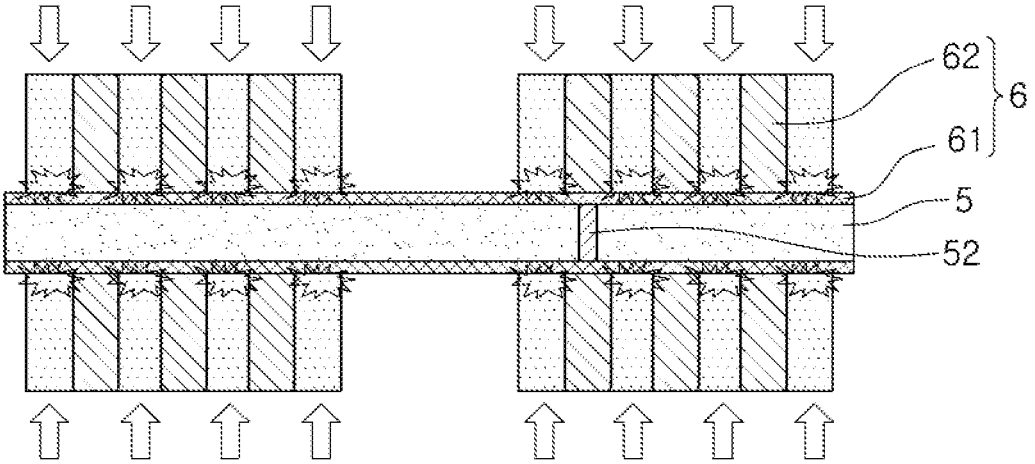

FIG. 4F illustrates simultaneously removing the insulator and the first plating layer disposed below the insulator. Here, among the first plating layers, the first plating layer disposed below the second plating layer is not removed. The method for removing the insulator and the first plating layer may be, for example, a laser trimming method, but is not limited thereto.

Figure 4G:
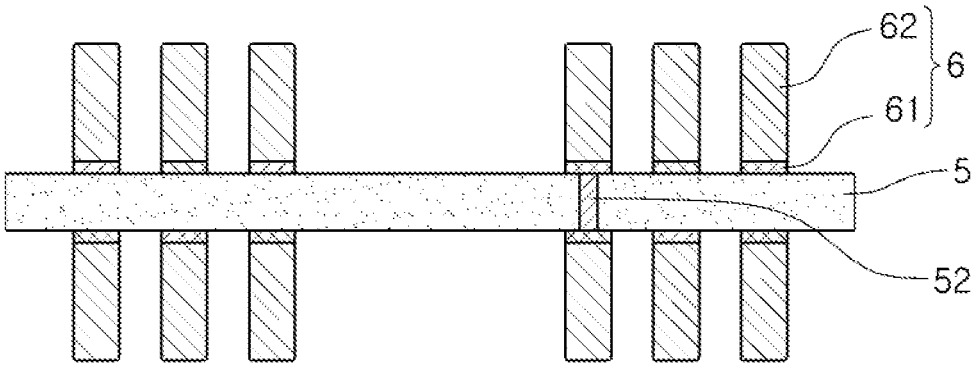

FIG. 4G illustrates the residue from the FIG. 4F removal of the insulator and first plating layer disposed below the insulator being washed away. The coil pattern composed of the second plating layer and the first plating layer disposed below the second plating layer may have a shape corresponding to the opening of the partition wall pattern of the insulator. Therefore, cross sections of the first and second plating layers are not changed in a thickness direction but may be formed to be substantially equal to each other, such that an aspect ratio of the coil pattern may be significantly increased, and an entire size of the inductor may also be miniaturized.

Figure 4H:
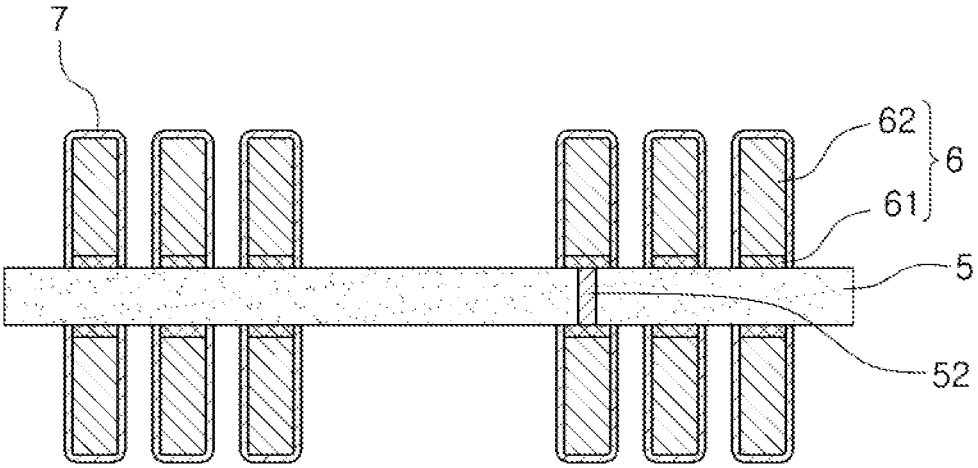

FIG. 4H illustrates coating an external surface of the coil pattern 6 composed of the first and second plating layers using a polymer resin 7. For example, a chemical vapor deposition (CVD) method, or a sputtering method may be used, but the method for coating the external surface of the coil pattern is not specifically limited. The polymer resin, which is, for example, a perylene resin, may serve to prevent a short-circuit between adjacent coil patterns.

Figure 4I:
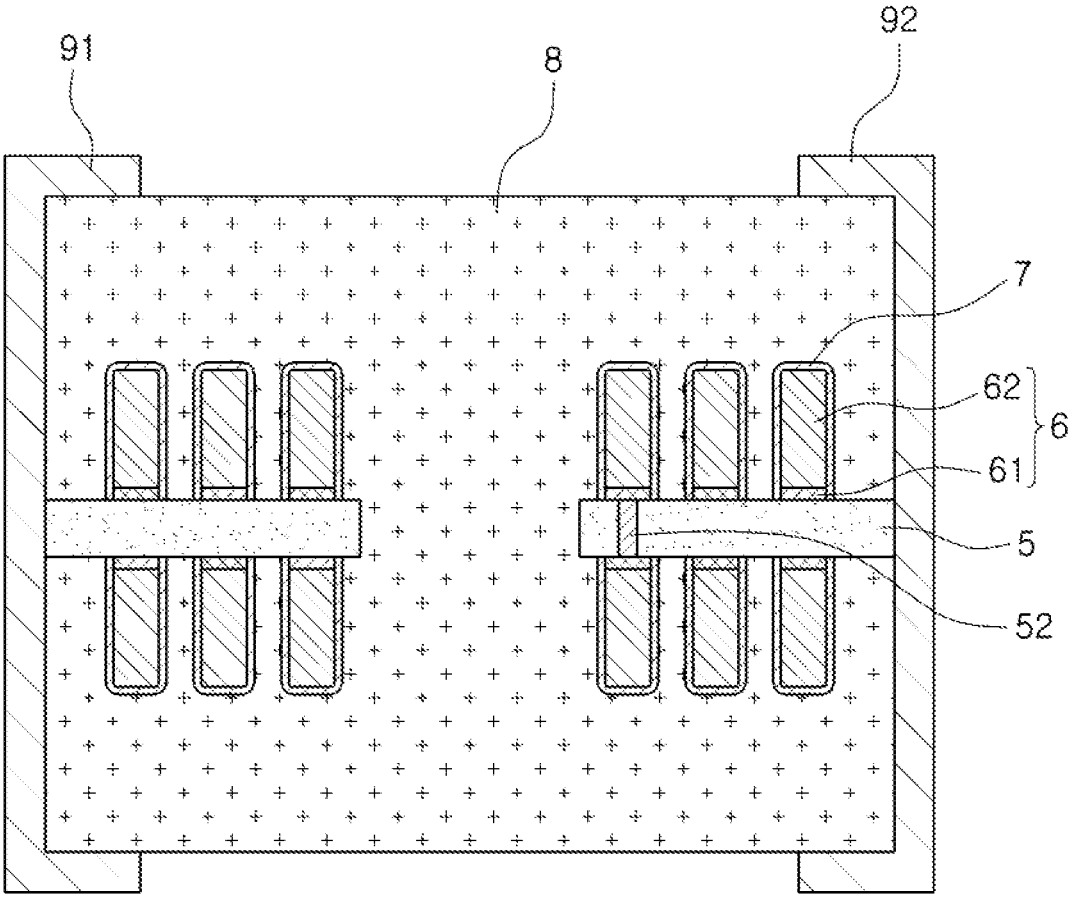

FIG. 4I illustrates forming external electrodes 91 and 92 after encapsulating the coil and the support member using an encapsulant 8 having magnetic properties and dicing the support member and the coil encapsulated by the encapsulant as a finishing process.

Except for the description described above, a description of features overlapping those of the above-mentioned inductor according to the exemplary embodiment in the present disclosure is omitted.

With the inductor and the method for manufacturing an inductor described above, the aspect ratio of the coil may be significantly increased, and the coil patterns may have a fine line width therebetween, such that the inductor may be miniaturized. Particularly, the mis-alignment problem may be completely solved by decreasing sensitivity for alignment between the opening of the insulator having the partition wall pattern required to form a uniform coil pattern and the seed layer required to fill the coil pattern in the opening. Therefore, the manufacturing yield of the inductor may be increased, such that cost competitiveness may be secured due to the increase in manufacturing yield.

As set forth above, according to exemplary embodiments in the present disclosure, production of the inductor having high inductance and a small size may be increased by improving alignment of the coils at the time of configuring the coils having a high aspect ratio.

While exemplary embodiments have been shown and described above, it will be apparent to those skilled in the art that modifications and variations could be made without departing from the scope of the present invention as defined by the appended claims.

What is claimed is:

1. An inductor comprising:

a body including a support member, a coil supported by the support member, and an encapsulant encapsulating the support member and the coil; and a first external electrode on a first external surface of the body and a second external electrode on a second external surface of the body, wherein the coil includes a first plurality of coil patterns on a first surface of the support member and a second plurality of coil patterns on a second surface of the support member opposite the first surface of the support member, each of the first and second plurality of coil patterns including a first coil layer and a second coil layer on the first coil layer, the encapsulant contains magnetic powder and fills spaces between adjacent coil patterns among the first and second plurality of coil patterns, the encapsulant extends to between adjacent coil patterns to be between first coil layers of adjacent coil patterns, the support member includes a via hole and a penetration via which fills the via hole, and the penetration via includes an exposed surface which is entirely covered by the first coil layer of at least one of the first or second plurality of coil patterns.

2. The inductor of claim 1, wherein a surface of the first and second plurality of coil patterns is coated by an insulating layer.

3. The inductor of claim 2, wherein a shape of the insulating layer depends on a shape of an external surface of the coil pattern on which the insulating layer is coated.

4. The inductor of claim 2, wherein the insulating layer contains perylene.

5. The inductor of claim 2, wherein the encapsulant fills spaces between insulating layers on adjacent coil patterns.

6. The inductor of claim 1, wherein a width of an upper surface of the first coil layer is substantially equal to that of a lower surface of the second coil layer.

7. The inductor of claim 1, wherein the coil has an aspect ratio of 2 to 20.

8. The inductor of claim 1, wherein an average distance between adjacent turns of the first coil layer is substantially equal to an average distance between adjacent turns of the second coil layer.

9. The inductor of claim 1, wherein the first and second coil layers are formed of different materials from each other.

10. The inductor of claim 9, wherein the first coil layer contains at least one of titanium (Ti), nickel (Ni) or molybdenum (Mo), and the second coil layer contains copper (Cu).

11. The inductor of claim 1, wherein the penetration via includes a material having electric conductivity, and the penetration via is discontinuous from a lower surface of the first coil layer on the penetration via.

12. The inductor of claim 11, wherein a material of the penetration via is different from that of the first coil layer.

* * * * *